US007864192B2

(12) United States Patent
Kim et al.

(10) Patent No.: US 7,864,192 B2
(45) Date of Patent: Jan. 4, 2011

(54) DITHERING SYSTEM AND METHOD FOR USE IN IMAGE PROCESSING

(75) Inventors: Chang-min Kim, Seo-gu (KR); Jae-chul Lee, Seocho-gu (KR); Jong-seon Kim, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 665 days.

(21) Appl. No.: 11/946,225

(22) Filed: Nov. 28, 2007

(65) Prior Publication Data

US 2008/0225054 A1 Sep. 18, 2008

(30) Foreign Application Priority Data

Mar. 16, 2007 (KR) ..... 10-2007-0026255

(51) Int. Cl.
*G09G 5/02* (2006.01)

(52) U.S. Cl. ..... 345/596; 345/690; 345/63

(58) Field of Classification Search ..... 345/596, 345/690

See application file for complete search history.

(56) References Cited

U.S. PATENT DOCUMENTS 5,586,203 A 12/1996 Spaulding et al.
6,069,609 A 5/2000 Ishida et al.
6,084,560 A * 7/2000 Miyamoto ..... 345/89
6,559,851 B1 * 5/2003 Schlapp ..... 345/531

FOREIGN PATENT DOCUMENTS

JP 2000182069 6/2000
KR 1020050076442 A 7/2005

* cited by examiner

*Primary Examiner*—M Good Johnson
(74) *Attorney, Agent, or Firm*—Volentine & Whitt, PLLC

(57) ABSTRACT

A dithering system includes a linear transformer, a dither data generator, an adder and a shifter. The transformer linearly transforms M bit input data using a linear function having a predetermined gradient in order to generate and output M bit transform data. The dither data generator generates and outputs M−N bit dither data. The adder adds the M bit transform data and the M−N bit dither data to generate and output M bit correction data. The shifter cuts off the bottom M−N bits of the M bit correction data in order to generate and output the N bit output data. The dithering system and associated dithering method widely disperses an error generated due to a physical limit of a data bit that can be expressed by a low gray scale system throughout the entirety of the gray scales when high gray scale image data is converted to low gray scale image data. This is done without using a lookup table which avoids using valuable chip area. In addition, by utilizing a plurality of adders and shifters rather than a multiplier and divider, the number of required logic gates is remarkably reduced as well as reducing associated power requirements.

23 Claims, 8 Drawing Sheets

FIG. 2 (PRIOR ART)

| 8 BIT INPUT DATA | | DITHER DATA | | | | 6 BIT OUTPUT DATA | | | |
|---|---|---|---|---|---|---|---|---|---|
| DECIMAL DNUMBER | BINARY NUMBER | BINARY NUMBER | | | | 1 FRAME | 2 FRAME | 3 FRAME | 4 FRAME |
| 0 | 0000 0000 | 00 | 01 | 10 | 11 | 000000 | 000000 | 000000 | 000000 |
| 1 | 0000 0001 | 00 | 01 | 10 | 11 | 000000 | 000000 | 000000 | 000001 |
| 2 | 0000 0010 | 00 | 01 | 10 | 11 | 000000 | 000000 | 000001 | 000001 |
| 3 | 0000 0011 | 00 | 01 | 10 | 11 | 000000 | 000001 | 000001 | 000001 |
| 4 | 0000 0100 | 00 | 01 | 10 | 11 | 000001 | 000001 | 000001 | 000001 |
| 5 | 0000 0101 | 00 | 01 | 10 | 11 | 000001 | 000001 | 000001 | 000010 |
| ⋮ | | | | | | | | | |
| 250 | 1111 1010 | 00 | 01 | 10 | 11 | 1111110 | 111110 | 1111111 | 1111111 |
| 251 | 1111 1011 | 00 | 01 | 10 | 11 | 1111110 | 111111 | 1111111 | 1111111 |
| 252 | 1111 1100 | 00 | 01 | 10 | 11 | 1111111 | 111111 | 1111111 | 1111111 |
| 253 | 1111 1101 | 00 | 01 | 10 | 11 | 1111111 | 111111 | 1111111 | 1111111 |
| 254 | 1111 1110 | 00 | 01 | 10 | 11 | 1111111 | 111111 | 1111111 | 1111111 |
| 255 | 1111 1111 | 00 | 01 | 10 | 11 | 1111111 | 111111 | 1111111 | 1111111 |

OVER FLOW

DITHERING SYSTEM AND METHOD FOR USE IN IMAGE PROCESSING

CROSS-REFERENCE TO RELATED PATENT APPLICATION

This application claims the benefit of Korean Patent Application No. 10-2007-0026255, filed on Mar. 16, 2007, in the Korean Intellectual Property Office, the disclosure of which is incorporated herein in its entirety by reference.

BACKGROUND OF THE INVENTION

1. Field of the Invention

Embodiments of the invention relate to an image data processing system. More particularly, embodiments of the invention relate to a dithering system and dithering method which can widely disperse an error generated due to a physical limitation of a data bit expressed by a low gray scale system.

2. Discussion of Related Art

A conventional method of displaying images includes converting an actual image to a digital signal, processing the image, and displaying the processed image via a display. The display outputs an image most representative of the actual image through a series of such processes. Various types of displays may be used to display images such as cathode ray tubes (CRT), thin film transistor liquid crystal displays (TFT-LCD), plasma display panels (PDP), etc.

The number of gray scales that can be expressed in an image is limited. For example, when 8 bits of Red (R), Green (G), and Blue (B) image signals are received from an external graphic source, but the image display can only express 6 bits of R, G, and B image signals, the image display is deficient by 2 bits of data from each R, G, and B image signal. As a result a false contour line in which a clear contour appears on the boundary of a screen or a mach's phenomenon in which a bright or dark line appears may occur. The false contour line and Mach's phenomenon deteriorates image quality requiring the use of dithering technology to correct the image.

A frame rate control (FRC) method may also be used to compensate for false contour lines and Mach's phenomenon. When using the FRC compensation method, a larger number of gray scales is expressed as an average brightness by controlling the gray scale. The FRC method can display a plurality of frames during one frame time in order to express gray scales associated with a frame. Hereinafter, it is assumed that received data comprises 8 bits and a drive integrated circuit can process data comprising 6 bits. A gray scale voltage corresponding to the 6 most significant bits of received 8 bit data is selected and the gray scale of a frame is controlled where the frame is divided into 4 segments having values (00, 01, 10, and 11) to represent the 2 least significant bits. For example, when the received 8 bit data is 11001011, four frames represented by data strings of 110010, 110011, 110011, and 110011 are displayed during one frame period. Accordingly, 8 bits of data can be expressed in 6 bit form.

FIG. 1 is a block diagram illustrating a conventional image display 100 having a timing controller 110, data driver 130, gate driver 140, and liquid crystal panel 150. A dithering system 120 may be installed inside timing controller 110. Timing controller 110 receives a vertical synchronization signal Vsync, a horizontal synchronization signal Hsync, a main clock MCLK signal, a data enable signal DE, and image data R, G, and B from an external graphic source (not shown). Timing controller 110 generates a first timing signal based on vertical synchronization signal Vsync and horizontal synchronization signal Hsync which controls the display of image data R, G, and B and outputs image data R, G, and B with the first timing signal to data driver 130. First timing signal includes load signal TP and horizontal synchronization start signal STH.

Timing controller 110 generates a second timing signal based on the vertical synchronization signal Vsync and the horizontal synchronization signal Hsync. The second timing signal controls the display of image data R, G, and B, and the second timing signal is outputted to gate driver 140. The second timing signal includes a gate selection signal CPV, a vertical synchronization start signal STV, and an output enable signal OE. Data driver 130 sequentially provides the R, G, and B image data corresponding to horizontal lines starting from a first horizontal line to source lines in response to the first timing signal. Gate driver 140 sequentially provides a gate voltage to the gate lines in response to the second timing signal. The liquid crystal panel 150 is formed of a plurality of thin film transistors with crossing points of the source and gate lines. When dithering system 120 is installed in timing controller 110, dithering system 120 converts M bit image data R, G, and B received from the external graphic source to N bit image data R', G', and B'. The N bit image data R', G', and B' is outputted to data driver 130. Accordingly, dithering system 120 uses M−N bit dither data where the dither data is added to the M bit image data R, G, and B, and the N bit image data R', G', and B' is generated by cutting off the bottom M−N bit.

FIG. 2 illustrates a table for describing a conventional dithering method where 8 bit input data received from an external graphic source may have 0 to 255 gray scales represented in binary number by 00000000 to 11111111. In order to express 8 bit data in 6 bit form, the bottom 2 bits of the 8 bit input data (Least Significant Bits LSB[1:0]) are cut-off. Thus, output data can only have 0 to 63 gray scales. The decrease in the number of gray scales may cause a false contour line or a Mach's phenomenon as described above.

As described above, the FRC method converts received M bit image data to N bit image data to process the M bit image data in N bit data driver where N<M. In other words, the FRC method is used to represent a frame as plural sub-frames by over-sampling the frames. Referring to FIG. 2, the 8 bit input data is over-sampled in order to make 4 segments of 8 bit input data. Then, the dither data is sequentially added to each of the 4 segments of 8 bit input data. The bottom 2 bits are cut-off in order to express the 4 segments of 8 bit input data as 4 sub-frames. The four sub-frames are all outputted to corresponding pixels in the same time as it takes one frame to be outputted.

In the dithering method, input data (00000010) is over-sampled to generate four strings of the input data. Next, dither data (00, 01, 10, 11) having different sizes are sequentially added to each of the over-sampled input data to generate binary values 00000010, 00000011, 00000100, and 00000101. The bottom 2 bits (LSB [1:0]) are then cut-off in order to generate 6 bit data 000000, 000000, 000001, and 000001. The four strings of 6 bit data are each applied to a corresponding pixel of a liquid crystal panel via a data driver. By using the dithering method, an average brightness of the 8 bit input data can be expressed through a plurality of strings of 6 bit output data, thereby improving resolution.

However, an error usually accompanies usage of the dithering method. For example, when input data is 11111100, the maximum value the input data can have by adding the dither data is 11111111. When the input data is 11111101, the maximum value the input data can have by adding the dither data is 100000000. Accordingly, even when the bottom 2 bits of the maximum value are cut-off, an image display cannot process the input data. This phenomenon is called "overflow." In an image display which receives M bit input data and outputs N bit output data, input data which exceeds (2M−1)−(2M−N−1) cannot be processed using the conventional dithering method. That is, when 8 bit data is converted to 6 bit data using the dithering method, 3 mappings of an output against an input cannot be realized. A look-up table is used in conventional dithering methods in order to form 3 inflection points in the vicinity of 255 by mapping input data exceeding 252 as 252. Alternatively, the dithering method uses a lookup table to disperse an inflection point throughout the entire gray scale value by converting 0 to 255 domains which is a gray scale value where the input data has 0 to 252 domains. However, several logic gates are used to form the lookup table which increases the chip area for the timing controller and requires additional power. This is disadvantageous especially in a portable high definition multiplayer providing high image resolution.

SUMMARY OF THE INVENTION

Exemplary embodiments of the present invention are directed to a dithering system utilized in image processing. In an exemplary embodiment, the dithering system includes a linear transformer which linearly transforms received M bit input data using a linear function having a predetermined gradient to generate and output M bit transform data where M is a natural number. A dither data generator is also included which is configured to generate and output M−N bit dither data where N is a natural number and N<M. An adder is connected to the linear transformer and the dither data generator. The adder is configured to add the M bit transform data from the linear transformer and the M−N bit dither data from the dither data generator to generate and output M bit correction data. A shifter is connected to the adder and is configured to cut-off the bottom M−N bits of the M bit correction data received from the adder to generate and output N bit output data.

BRIEF DESCRIPTION OF THE DRAWINGS

FIG. 2 illustrates a table for describing a conventional dithering method;

DESCRIPTION OF EMBODIMENTS

Figure 1:
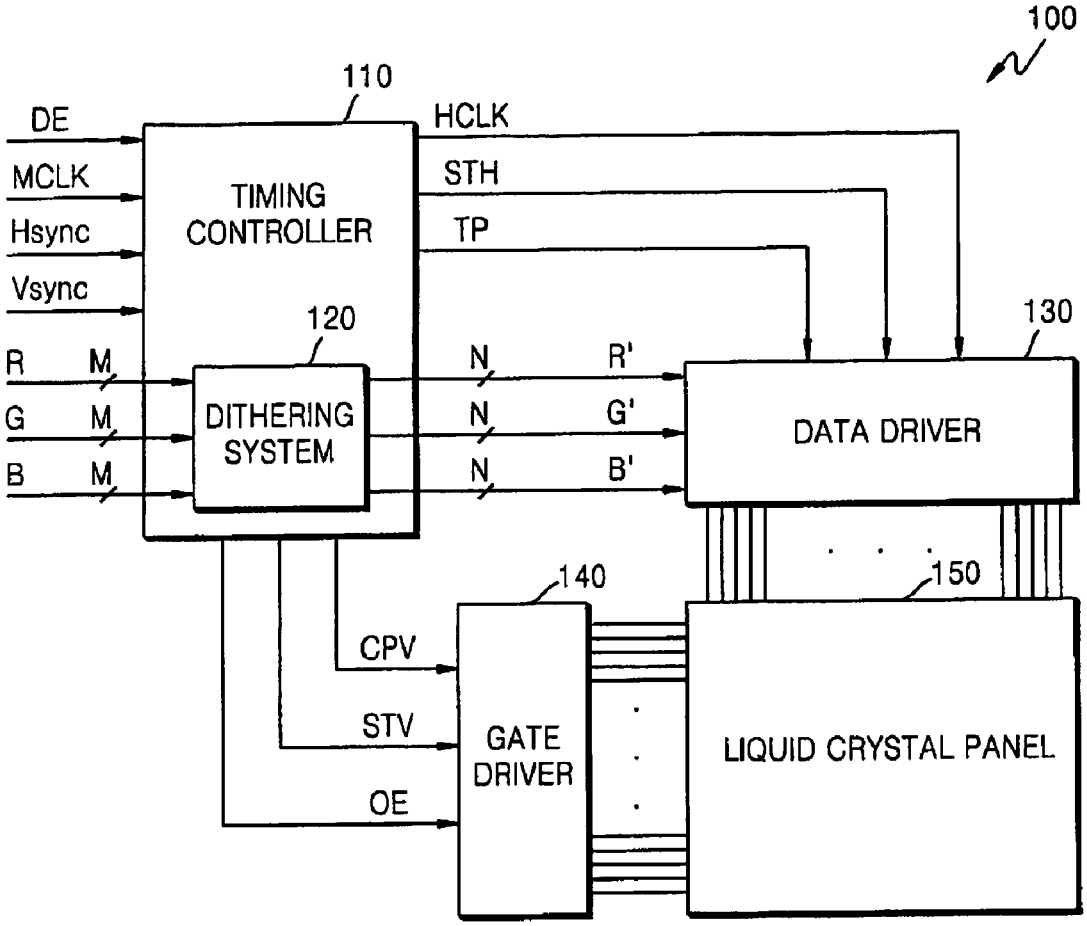
FIG. 1 (PRIOR ART)
FIG. 1 is a block diagram illustrating a conventional image display.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 3:
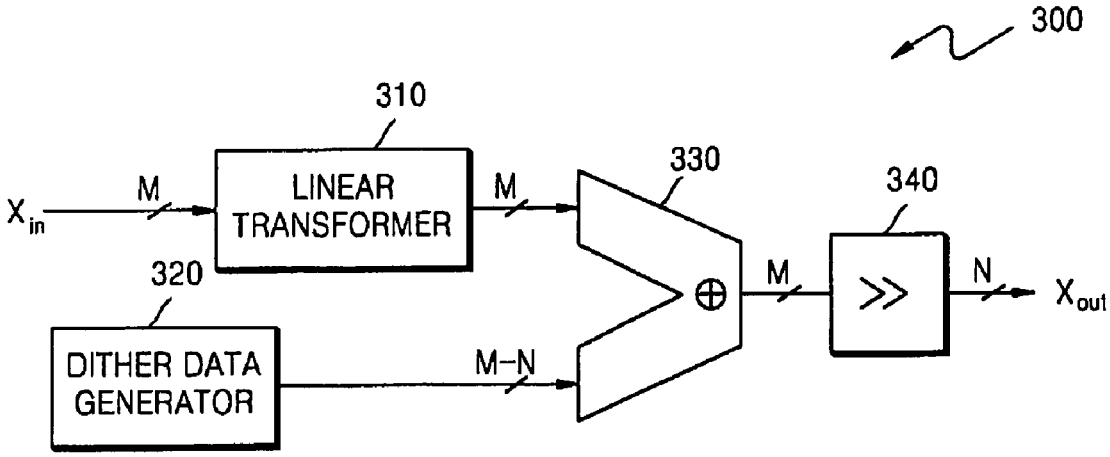
FIG. 3 is a block diagram illustrating a dithering system according to an embodiment of the present invention.

FIG. 3 is a block diagram illustrating a dithering system 300 including linear transformer 310, dither data generator 320, adder 330, and shifter 340. Linear transformer 310 generates M bit transform data (where M is a natural number) by linearly transforming M bit input data received from an external graphic source using a linear function. Linear transformer 310 outputs the M bit transform data to adder 330. Although not illustrated in detail, an over-sampling unit which over-samples the M bit input data in order to perform a frame rate control (FRC) may be disposed before or after linear transformer 310.

The linear transformer 310 linearly transforms 0 to 2M−1 gray scale values to 0 to (2M−1)−(2M−N−1) gray scale values where M and N are natural numbers and N<M. For example, when M is 8 and N is 6, linear transformer 310 linearly transforms 0 to 255 gray scale values to 0 to 252 gray values. Dither data generator 320 generates and outputs M−N bit dither data to adder 330. Dither data generator 320 can generate and output 2 bit dither data, such as 00, 01, 10, and 11 to adder 330. Alternatively, dither data generator 320 sequentially generates and outputs M−N bit dither data having different logic levels to adder 330. Adder 330 generates M bit correction data by adding the M bit transform data received from linear transformer 310 and the M−N bit dither data received from dither data generator 320. Adder 330 generates M bit correction data by adding each of the over-sampled M bit transform data and corresponding M−N bit dither data. Shifter 340 generates N bit output data by cutting off the bottom M−N bits of the M bit correction data received from adder 330. Shifter 340 may be a barrel shifter which shifts a plurality of bits in one calculation. Shifter 340 generates N bit output data by shifting the M bit correction data to the right by M−N bits and then cutting off the bottom M−N bits.

Figure 4:
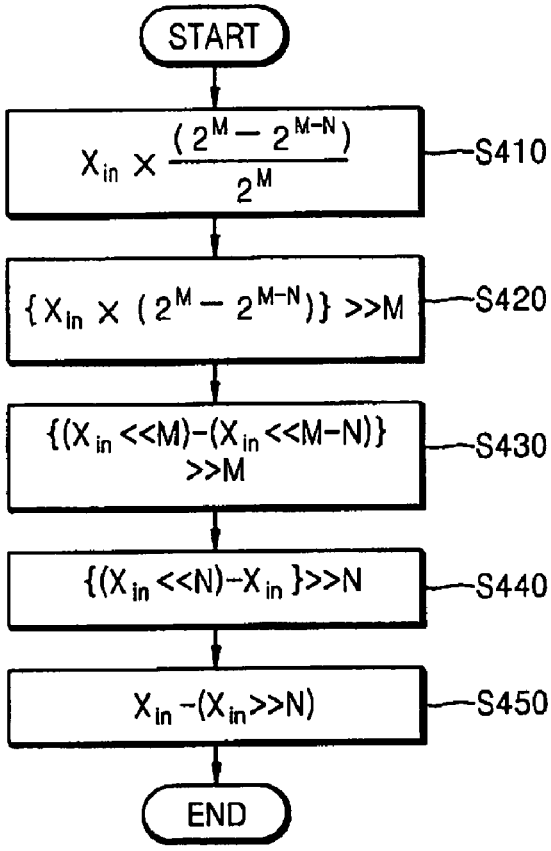
FIG. 4 is a flowchart illustrating processes of a linear transformer illustrated in FIG. 3.

FIG. 4 is a flowchart illustrating processes of the linear transformer 310 illustrated in FIG. 3. which transforms the M bit input data using Equation 1:

$$y = \frac{(2^M - 1) - (2^{M-1} - 1) + \alpha_{OFFSET}}{2^M - 1 - \beta_{OFFSET}} \times (x + \gamma_{OFFSET}) \quad (1)$$

where, x is M bit input data, y is M bit transform data, and αOFFSET, βOFFSET, γOFFSET are variables. Linear transformer 310 is formed of a fixed point calculation processor which is advantageous in terms of utilized circuit area and power consumption. An accumulation of errors due to a fixed point calculation can be resolved by regulating the variables αOFFSET, βOFFSET, and γOFFSET. For example, when βOFFSET is 1, γOFFSET can also be 1 to minimize error accumulation. Variable βOFFSET may be set to 1 since generally, a plurality of logic gates is required to perform division, but when a denominator of the slope of the linear function can be expressed in 2i (where i is an integer), the division can easily be performed by using shifter 340.

Also, the numerator of the slope of the linear function may be converted as shown in Equation 2 below before performing the linear transformation.

$$\alpha = \sum_{i=0}^{M-1} C_i \times 2^i,\ C_{optimum\,set} = \arg\min \sum |C_i| \tag{2}$$

For example, when M is 8, N is 6, and variable αOFFSET is 0, the numerator (α) of the slope of the linear function is 252. When this value is expressed as a binary number, it may be 1×27+1×26+1×25+1×24+1×23+1×22+0×21+0×20 or 1×28+(−)×22. Since the latter satisfies the above condition, 252 is converted to 1×28+(−)×22. In this manner, the number of adders required can be significantly reduced.

The linear function can be expressed as Xin×(2M−2M−N)/2M in step S410. Here, it is assumed that variables αOFFSET and γOFFSET are 0, and variable βOFFSET is 1 for convenience. The linear function may be expressed as Xin×(2M−2M−N>>M in step S420. In step S430, the linear function may be expressed as {(Xin<<M)−(Xin<<M−N)}>>M. The linear function may be expressed as {(Xin<<N)−Xin}>>N in step S440. In step S450, the linear function may be expressed as Xin−(Xin>>N) in operation S450 where ">>" is a right shift operation and "<<" is a left shift operation. The linear function can be simply expressed through steps S410 through S450 and the linear transformation can be performed using a simple addition and shift calculation without the use of the multiplication and division operations. Accordingly, through the above processes, linear transformer 310 shown in FIG. 3 performs the linear transformation using only adder 330 and shifter 340 without the use of a multiplier or a divider, thereby conserving valuable circuit area.

Figure 5:
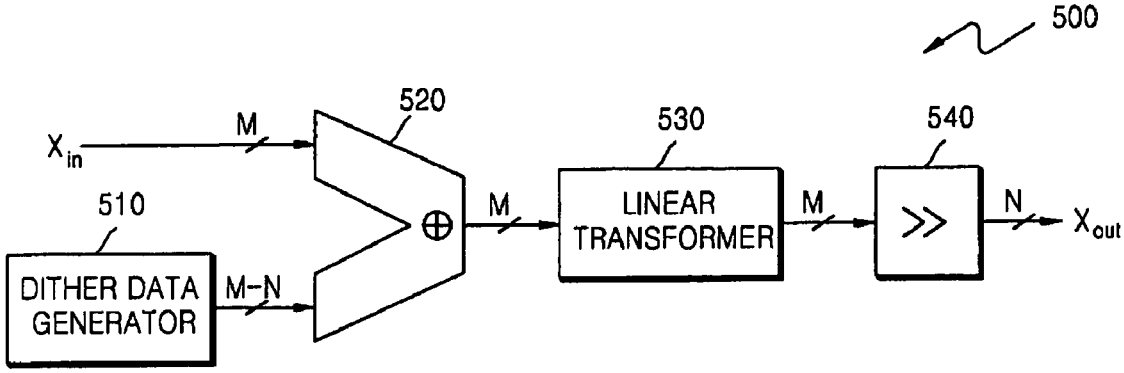
FIG. 5 is a block diagram illustrating a dithering system according to an embodiment of the present invention.

FIG. 5 is a block diagram illustrating dithering system 500 including dither data generator 510, adder 520, linear transformer 530, and shifter 540. The difference between the dithering system 300 of FIG. 3 and the dithering system 500 of FIG. 5 is primarily the location of the linear transformer. The location of the linear transformer 530 can be determined based on an error and source of dithering system 500. Dither data generator 510 generates and outputs M−N bit dither data, for example 00, 01, 10 and 11 to adder 520. In addition, dither data generator 510 may sequentially generate and output the M−N bit dither data having different logic levels to adder 520.

Adder 520 generates M bit correction data by adding M bit input data received from an external graphic source (not shown), and the M−N bit dither data received from dither data generator 510. Although not illustrated in FIG. 5, an over-sampling unit over-samples and outputs the M bit input data to adder 520 in order to perform FRC which may be installed before adder 520. Adder 520 generates the M bit correction data by adding the over-sampled M bit input data and the M−N bit dither data. Linear transformer 530 generates and outputs M bit transform data to shifter 540 by transforming the M bit correction data received from adder 520 using a linear function. In particular, linear transformer 530 linearly transforms gray scale values of 0 to {(2M−1)+(2M−N−1)} to gray scale values of 0 to {(2M−1)−(2M−N−1)}. For example, when M is 8 and N is 6, linear transformer 530 linearly changes gray scale values of 0 to 258 to gray scale values of 0 to 252.

Shifter 540 generates N bit output data by cutting off the bottom M−N bit of the M bit transform data received from linear transformer 530. Shifter 540 may be a barrel shifter configured to shift a plurality of bits in one calculation. Shifter 540 generates N bit output data by cutting off the bottom M−N bits after shifting the M bit transform data to the right by M−N bits.

Figure 6:
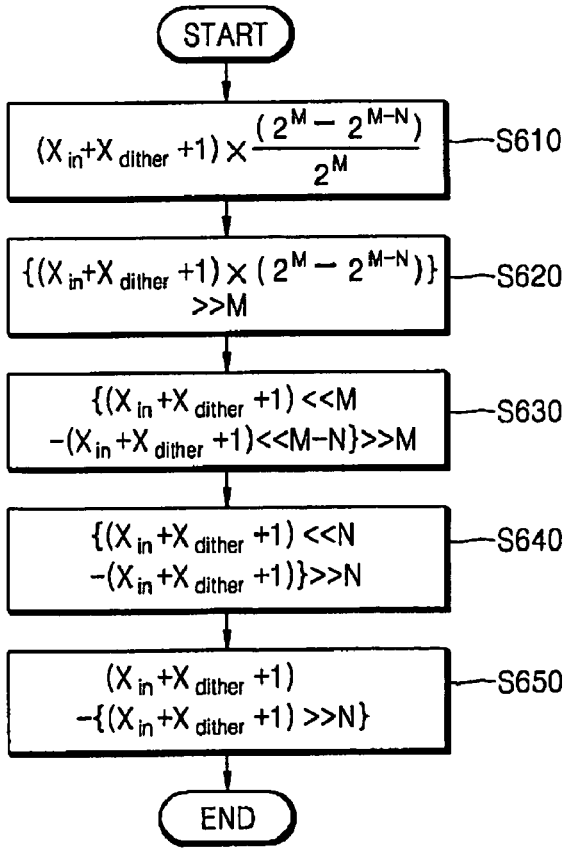
FIG. 6 is a flowchart illustrating processes of a linear transformer illustrated in FIG. 5.

FIG. 6 is a flowchart illustrating processes of the linear transformer 530 illustrated in FIG. 5. Linear transformer 530 linearly transforms the M bit correction data using Equation 3.

$$y = \frac{(2^M - 1) - (2^{M-N} - 1) + \alpha_{OFFSET}}{(2^M - 1) + (2^{M-N} - 1) - \beta_{OFFSET}} \times (x + x_{dither} + \gamma_{OFFSET}) \tag{3}$$

where x is M bit input data, xdither is M−N bit dither data, y is M bit transform data, and αOFFSET, βOFFSET, γOFFSET are variable numbers.

As described above, linear transformer 530 is formed of a fixed point operation processor which is advantageous in terms of occupied circuit area and power consumption. Also, βOFFSET may be set to 1 for convenient linear transform calculation. A numerator of the linear function may be converted to a number that satisfies conditions of Equation 2, before performing the linear transform. The linear function can be expressed as (Xin+Xdither+1)×(2M−2M−N)/2M as shown in step S610 where, for convenience, αOFFSET is 0, γOFFSET is 1, and βOFFSET is 2−2M−N. In step S620, the linear function can be expressed as {(Xin+Xdither+1)×(2M−2M−N)}>>M. In step S630, the linear function can be expressed as {(Xin+Xdither+1)<<M−(Xin+Xdither+1)<<M−N)}>>. In step S640, the linear function can be expressed as {(Xin+Xdither+1)>>(N−(Xin+Xdither+1)}>>N. In step S650, the linear function can be expressed as (Xin+Xdither+1)−{(Xin+Xdither+1)>>N}. Here, "<<" is a right shift operation and "<<" is a left shift operation.

The linear function can be expressed via steps S610 through S650 and the linear transform can be performed via simple adding and shift calculations without the need for multiplication and division operations. Accordingly through the above processes, the linear transformer 530 illustrated in FIG. 5 can perform multiplication and division using adder 520 and shifter 540 without using a multiplier and a divider avoiding the use of valuable circuit area and power.

Figure 7:
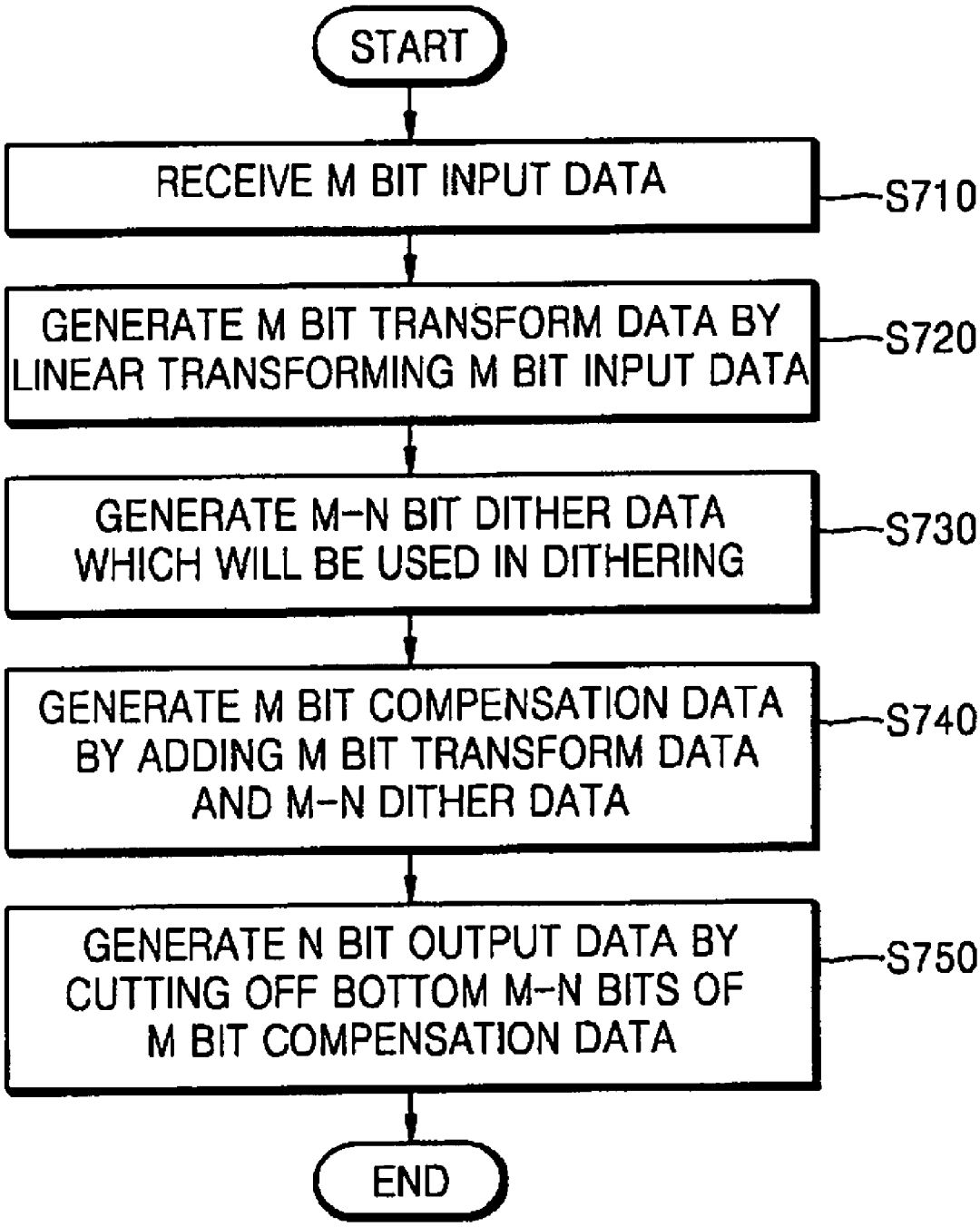
FIG. 7 is a flowchart illustrating a dithering method according to an embodiment of the present invention.

FIG. 7 is a flowchart illustrating a dithering method in accordance with an embodiment of the invention. M bit input data is received from an external graphic source in step S710 where M may be, for example, 8. M bit transform data is generated by linearly transforming the M bit input data in step S720. The linear transform is performed using the linear function shown in Equation 1. M−N bit dither data used in dithering is generated in step S730 where the M−N bit dither data may be 2 bit data. In step S740, M bit correction data is generated by adding the M bit transform data and the M−N bit dither data. In step S750, N bit output data (where N may be, for example 6) is generated by cutting off the bottom M−N bits of the M bit correction data through the use of a barrel shifter.

Figure 8:
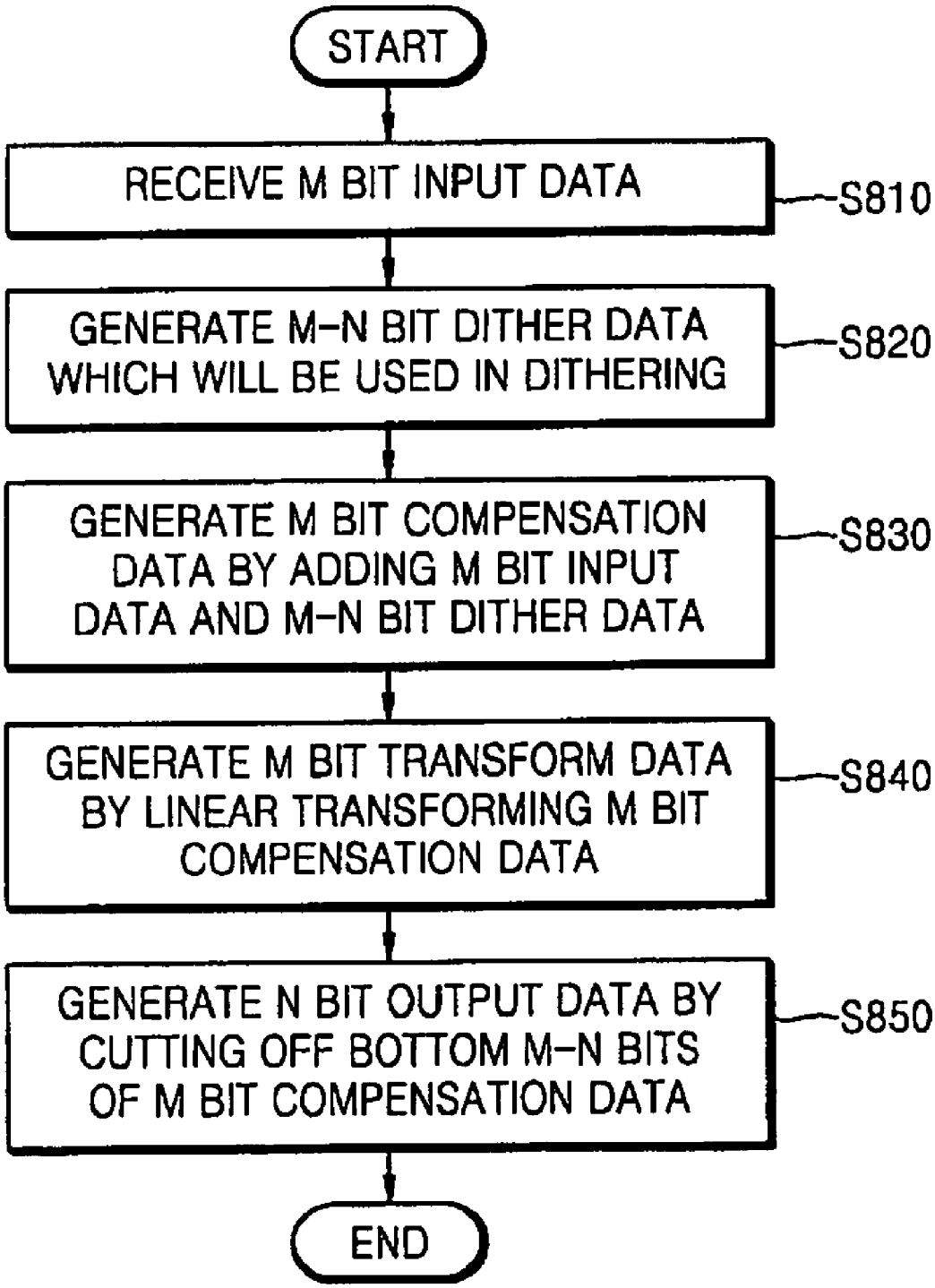
FIG. 8 is a flowchart illustrating a dithering method according to an embodiment of the present invention.

FIG. 8 is a flowchart illustrating a dithering method in accordance with an embodiment of the invention. In step S810, M bit input data is received from an external graphic source (where M may be 8). The, M−N bit dither data to be used in the dithering operation is generated in step S820. The M−N bit dither data may be, for example, 2 bits. M bit correction data is generated in step S830 by adding the M bit input data and the M−N bit dither data. In step S840, M bit transform data is generated by linearly transforming the M bit correction data. The linear transform is performed using the linear function shown in Equation 3. In step S850, N bit output data (where N may be, for example 6) is generated by cutting off the bottom M−N bits of the M bit transform data. The cutting of the bottom bits may be performed using a barrel shifter.

Figure 9:
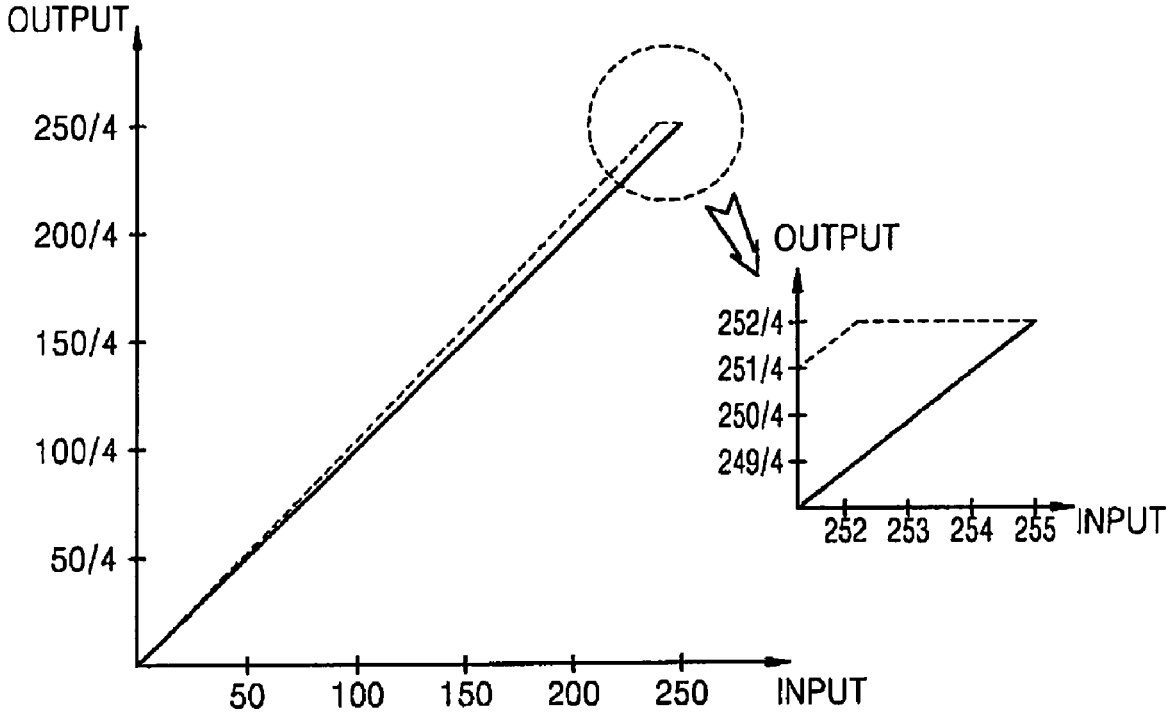
FIG. 9 is a graph for comparing effects of the present invention and the prior art.

FIG. 9 is a graph for illustrating and comparing the effects of the present invention and the prior art. The dotted line shows a correlation between input data and output data according to the prior art. The solid line shows a correlation between input data and output data according to the present invention. The correlation between the input data and output data is nonlinear using a conventional dithering method, but the correlation between the input data and output data is linear using the dithering method of the present invention.

Figure 10:
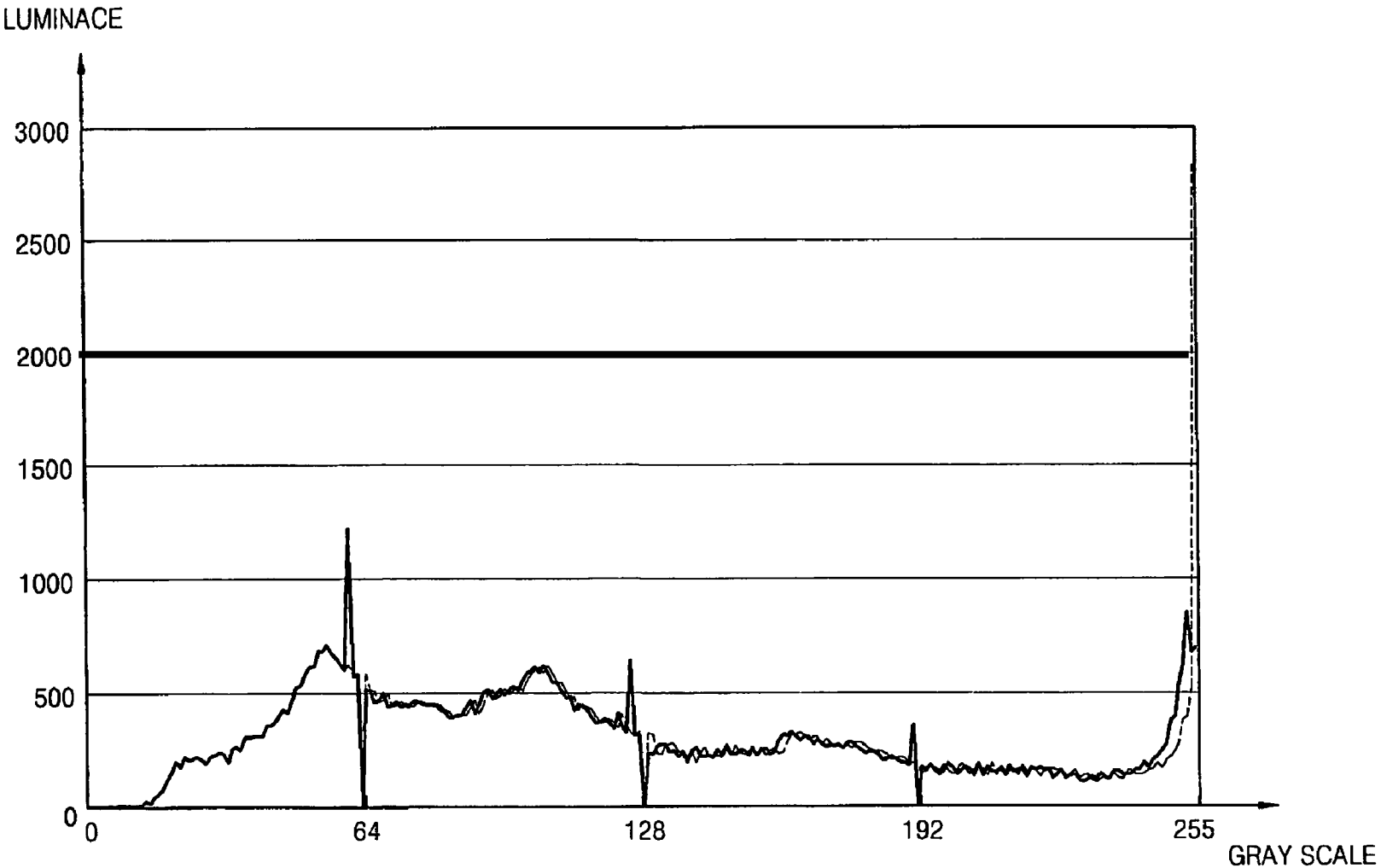
FIG. 10 is a histogram for comparing effects of the present invention and the prior art.

FIG. 10 is a histogram for comparing effects of the present invention and the prior art. The dotted line is a histogram of output data according to the prior art, and the solid line is a histogram of output data according to the present invention. As can be seen, the luminance increases remarkably in the vicinity of the gray scale value of 255 using a conventional dithering method, but luminance slightly increases in the vicinity of gray scale values of 64, 128, and 192 using the dithering method of the present invention. In other words, by using the dithering method of the present invention a drastic change in the histogram does not occur and the image can be displayed without significant degradation.

The dithering system and dithering method of the present invention transforms input data using a linear function. An error generated in the dithering system can be widely dispersed throughout the entire range of gray scales, thereby reducing the circuit area while increasing operation speeds. In addition, the dithering system and dithering method performs the linear transform using an adder and a shifter without the use of a multiplier and a divider. In this manner, the number of logic gates required to form the multiplier and divider is obviated which also reduces power consumption requirements.

Although the present invention has been described in connection with the embodiment of the present invention illustrated in the accompanying drawings, it is not limited thereto. It will be apparent to those skilled in the art that various substitutions, modifications and changes may be made thereto without departing from the scope and spirit of the invention.

What is claimed is:

1. A dithering system utilized in image processing, the dithering system comprising:

a linear transformer which linearly transforms received M bit input data using a linear function having a predetermined gradient to generate and output M bit transform data where M is a natural number;

a dither data generator configured to generate and outputs M−N bit dither data where N is a natural number and N<M;

an adder connected to the linear transformer and the dither data generator, the adder configured to add the M bit transform data from the linear transformer and the M−N bit dither data from the dither data generator to generate and output M bit correction data; and a shifter connected to the adder and configured to cut-off the bottom M−N bits of the M bit correction data received from the adder to generate and output N bit output data.

2. The dithering system of claim 1 wherein the gradient of the linear function is $$\frac{2^M - 1 - (2^{M-N} - 1) + \alpha_{OFFSET}}{2^M - 1 + \beta_{OFFSET}}$$

where αOFFSET is a first variable and βOFFSET is a second variable.

3. The dithering system of claim 2 wherein the linear function has a y intercept equal to the gradient of the linear function.

4. The dithering system of claim 2 wherein a numerator a of the slope of the linear function is converted to satisfy $$\alpha = \sum_{i=0}^{M-1} C_i \times 2^i,\ C_{optimum\,set} = \arg\min \sum |C_i|.$$

5. The dithering system of claim 4 wherein βOFFSET is 1.

6. The dithering system of claim 5 wherein the linear transformer is formed only of a plurality of adders in combination with a plurality of shifters.

7. The dithering system of claim 6 wherein the shifter is a barrel shifter.

8. The dithering system of claim 1 further comprising an over-sampling unit connected to the linear transformer is configured to over-sample the M bit input data to generate 2(M−N) identical strings of each M bit input data string and output the M−N identical strings to the linear transformer.

9. The dithering system of claim 1 wherein the linear transformer performs a fixed point calculation.

10. The dithering system of claim 1 wherein the N output data is supplied to a liquid crystal display.

11. A dithering system utilized in image processing which converts received M bit input data to N bit output data where M and N are natural numbers and N<M, the dithering system comprising:

a dither data generator configured to generate and output M−N bit dither data;

an adder connected to the dither data generator configured to add the M bit input data and the M−N bit dither data received from the dither data generator to generate and output M bit correction data;

a linear transformer connected to the adder and receiving the output M bit correction data, the linear transformer configured to linearly transform the M bit correction data using a linear function in a predetermined slope to generate and output M bit transform data; and a shifter connected to the linear transformer and configured to cut-off the bottom M−N bits of the M bit transform data to generate and output the N bit output data.

12. The dithering system of claim 11 wherein the gradient of the linear function is $$\frac{2^M - 1 - (2^{M-N} - 1) + \alpha_{OFFSET}}{2^M - 1 + (2^{M-N} - 1)\beta_{OFFSET}}$$

where αOFFSET is a first variable and βOFFSET is a second variable.

13. The dithering system of claim 12 wherein a numerator a of the gradient of the linear function is converted to satisfy $$\alpha = \sum_{i=0}^{M-1} C_i \times 2^i,\ C_{optimum\,set} = \arg\min \sum |C_i|.$$

14. The dithering system of claim 13 wherein βOFFSET is 2−2M−N.

15. The dithering system of claim 11 further comprising an over-sampling unit connected to the adder is configured to over-sample the M bit input data to generate 2(M−N) identical strings of each M bit input data string and output the M−N identical strings to the adder.

16. The dithering system of claim 11 wherein M is 8 and N is 6.

17. The dithering system of claim 11 wherein the dither data generator sequentially generates and outputs M−N bit dither data having different logic levels.

18. A dithering method utilized in image processing which converts M bit input data to N bit output data using dither data wherein M and N are natural numbers and N<M, the dithering method comprising:

linearly transforming the M bit input data to M bit transform data using a linear function having a predetermined gradient;

outputting the M bit transform data;

generating and outputting M−N bit dither data;

adding the M bit transform data and the M−N bit dither data to generate and output M bit correction data; and generating and outputting the N bit output data by cutting off the bottom M−N bits of the M bit correction data.

19. The dithering method of claim 18 further comprising:

generating 2(M−N) identical strings of each M bit input data string by over-sampling the M bit input data; and outputting the 2(M−N) identical strings to undergo the linear transformation of the M−N pieces of M bit input data to M−N pieces of M bit transform data.

20. The dithering method of claim 18 further comprising supplying the N bit output data to a liquid crystal display.

21. A dithering method utilized in image processing which converts M bit input data to N bit output data using dither data wherein M and N are natural numbers and N<M, the dithering method comprising:

generating and outputting M−N bit dither data;

generating and outputting M bit correction data by adding the M bit input data and the M−N bit dither data;

linearly transforming the M bit correction data to M bit transform data using a linear function having a predetermined gradient;

outputting the M bit transform data; and generating and outputting the N bit output data by cutting off the bottom M−N bits of the M bit transform data.

22. The dithering method of claim 21, further comprising:

generating 2(M−N) identical strings of each M bit input data string by over-sampling the M bit input data;

outputting the 2(M−N) identical strings of each M bit input data wherein the M bit correction data and the M−N strings of M bit correction data are generated and output by adding the over sampled 2(M−N) identical strings of each M bit input data string and a corresponding plurality of portions of M−N bit dither data.

23. The dithering method of claim 21 wherein a plurality of portions of M−N bit dither data having different logic levels is sequentially generated and outputted.

* * * * *